US005765081A

United States Patent [19]

Bogaert et al.

[11] Patent Number: 5,765,081

[45] Date of Patent: Jun. 9, 1998

[54] ELECTROSTATOGRAPHIC MULTI-COLOR PRINTER FOR DUPLEX PRINTING ON A WEB-TYPE TONER RECEPTOR MATERIAL

[75] Inventors: Jan Van den Bogaert, Schilde; Leo Vackier, Gravenwezel, both of Belgium

[73] Assignee: AGFA-Gevaert, Mortsel, Belgium

[21] Appl. No.: 636,829

[22] Filed: Apr. 23, 1996

[30] Foreign Application Priority Data

May 9, 1995 [EP] European Pat. Off. ..... 95201186

[51] Int. Cl.[6] ..... G03G 15/01

[52] U.S. Cl. ..... 399/299; 399/306

[58] Field of Search ..... 399/298, 299, 399/303, 306, 307, 309, 312, 313, 315

[56] References Cited

U.S. PATENT DOCUMENTS

| | | | |
|---|---|---|---|
| 3,580,670 | 5/1971 | Bhagat | 399/306 |
| 3,694,073 | 9/1972 | Bhagat . | |
| 4,427,285 | 1/1984 | Stange . | |
| 4,731,631 | 3/1988 | Monkelbaan et al. | 399/306 |
| 5,138,363 | 8/1992 | Yuge . | |
| 5,177,542 | 1/1993 | Lubberts | 399/298 X |
| 5,526,107 | 6/1996 | Bronstein | 399/299 |
| 5,550,624 | 8/1996 | Wachtler | 399/306 |
| 5,623,719 | 4/1997 | De Cook et al. | 399/299 |

FOREIGN PATENT DOCUMENTS 0629924 12/1994 European Pat. Off. .

*Primary Examiner*—William J. Royer
*Attorney, Agent, or Firm*—Baker & Botts, L.L.P.

[57] ABSTRACT

An electrostatographic printing apparatus is provided that is adapted for single-pass sequential multi-color duplex printing wherein the printing involves deposition and fixation of toner particles on a web-type final substrate. The apparatus includes: a first printing system having a first guiding member; a second printing system having a second guiding member, the printing systems being arranged in succession at opposite sides of the final substrate; an apparatus for rotating the guiding members and conveying the final substrate; an apparatus in each of the printing systems for superimposing color separation images in registration on the final substrate, wherein the color separation images are toner images including the toner particles; and an apparatus located between the first and second printing systems for reversing the charge polarity of the toner particles deposited onto the final substrate in the first printing system when the toner particles in the printing systems have the same charge polarity.

25 Claims, 2 Drawing Sheets

ELECTROSTATOGRAPHIC MULTI-COLOR PRINTER FOR DUPLEX PRINTING ON A WEB-TYPE TONER RECEPTOR MATERIAL

DESCRIPTION

FIELD OF THE INVENTION

The present invention relates to an electrostatographic printing apparatus suited for single-pass sequential multi-color duplex printing on a web-type receptor material.

BACKGROUND OF THE INVENTION

For many years printing proceeds with letterpress, gravure (intaglio) or planographic (lithographic) printing machines wherein a printing ink receptor, usually paper, makes direct contact with an inked printing form [ref. e.g. Printing Technology by J. Michael Adams et al. —Delmar Publishers Inc. (1988)].

Printing presses are classified into sheet-fed and web-fed printing presses.

Nowadays other printing processes, so-called non-impact printing processes have found application, e.g. electrostatographic printing, (ref. e.g. "Principles of Non-Impact Printing" by Jerome L. Johnson (1986)—Palatino Press—Irvine Calif., 92715 U.S.A.).

Electrostatographic printing includes electrographic printing in which an electrostatic charge is deposited image-wise, e.g. by ionography, on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on the recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored information.

In order for said electrostatographic non-impact printing system to be competitive with classical "impact" or "contact" printing it has to be adapted for high speed printing at long runs and has to possess the capability of printing on both sides (duplex printing) which is common praxis in printing of books and journals.

In classical sequential duplex printing with common printing ink, e.g. used in lithographic offset printing on web-type material, reversing or turner mechanisms are applied for reversing the web and feeding it into a next printing station [ref. e.g. "The Printing Industry" by Victor Strauss Published by Printing Industries of America Inc. 20 Chevy Chase Circle, N. W., Washington, D.C. 20015 (1967) p. 512–514].

An example of a non-impact electrophotographic printing machine for sequential duplex printing on a paper web is given in U.S. Pat. No. 3,694,073. The printing method described therein (see FIG. 1) is not suited for full color printing and allows only the printing of monochrome images on each side of the printing web.

In the printing apparatus of said U.S. Pat. No. registration problems arise as is the case in full color printing wherein different monochrome ink-images (yellow, magenta, cyan and black) have to be superposed in registration.

Nowadays printing systems have gone digital in that the printing information is stored and fed to the printing machine in digital electronic form modulating the photo-exposure of pre-charged photoconductive imaging elements or modulating directly electrostatic charging as takes place in ionographic printing machines.

A recent survey of digital printing systems is given in "Informationen"—Wiesbaden January 1994 Art.-Nr. 86028 (pages 1–20) by Andreas Weber, edited by Bundesverband Druck E. V. Abt. Technik+ Forschung, Biebricher Allee 79, D-65 187 Wiesbaden—Germany.

In that article two new-comer electrophotographic digital printing systems marketed under the tradename XEIKON DCP-1 of XEIKON N.V. Belgium and tradename E-PRINT 1000 of INDIGO company have been discussed respectively. The digitally operated multi-color electrophotographic printing machine XEIKON DCP-1 (tradename) (see also published European patent applications 629 924 and 631 204) is capable of simultaneous duplex printing with good image registration by using a printing web driving all the photoconductive printing drums, whereas the E-PRINT 1000 (tradename) (see page 14 of the above mentioned article) operates with paper sheets and requires a turning mechanism for printing on both sides of the paper sheets whereby it is impossible to print continuously varying information on a receptor of practically infinite length as is possible with the web-fed XEIKON DCP-1 (tradename). Printing on paper with exceptionally long length is applied in practice e.g. in printing of a continuously varying stream of computer data or in the printing of wall paper wherein the length of the printing pattern largely exceeds the length of the printing drum.

In the duplex printer of published EP-A 629 924 using a printing web driving all the photoconductive printing drums the paper web makes good adherent contact with said drums over a certain wrapping angle; such requires however that following each direct current transfer corona serving for toner transfer onto said web an alternating current corona has to be present to ease the release of the paper web from the successive drums and to avoid sparking during that release.

Moreover, duplex printing on a paper web with more than three printing stations in staggered position with respect to the web requires according to published EP-A 631 204 means for controlling the electrostatic polarity of the toner already present on the web in advance of the third and each subsequent image-producing stations, to enable the transfer of a toner image at a third and any subsequent image-producing stations without disturbing the image transferred to the same side of the web at a previous image-producing station (see claims 3 and 4 of said EP-A). The introduction of all these coronas for good quality printing of the electrostatographic duplex printer makes that a considerable amount of ozone and ionized gases are produced that may not enter into the environment and require their removal or neutralization.

The duplex printer according to said EP-A 631 204 contains a reversing roller (150) as illustrated therein in FIGS. 2A and 2B. As can be learned from FIG. 4 and 5 said reversing roller makes contact with a second toner-developed side of a web-type printing stock. In order to counteract toner image distortion on the receptor web before final fixing said reversing roller is associated with additional corona devices and a cleaning unit.

SUMMARY OF THE INVENTION

It is an object of the present invention to provide an electrostatographic printer, i.e. printing machine, suited for single-pass sequential multi-color duplex printing on a final substrate in web form in good registration at both sides of the final substrate in web form, and wherein on using two printing systems the reversing of the polarity of already deposited toner images after a first printing system has to proceed no more than once for preventing loss of transferred toner from the final substrate in web form.

It is a further object of the present invention to provide an electrostatographic single-pass sequential duplex printer operating with two printing systems wherein the reversing of the polarity of toner particles already deposited on a receptor final substrate in web form in the first printing system is not necessary for obtaining high quality printing without toner loss.

Other objects and advantages of the present invention will appear from the further description.

The objects of the present invention are realized by providing an electrostatographic printing apparatus suited for single-pass sequential multi-color duplex printing, characterized in that said printing proceeds by depositing and fixing toner particles on a final substrate (1) in web form and said apparatus comprises :

1) two printing systems, a first (I) and a second (II) one, being arranged in succession at opposite sides of said final substrate (1), each of said printing systems comprising a guiding member (3) in the form of a rotatable endless surface member,
2) means for rotating said guiding member (3) for conveying said final substrate (1),
3) means, in each of said printing systems, for superimposing color separation images, in the form of toner images, in registration on said final substrate (1) conveyed by said guiding member (3), and
4) means (18, 19) for reversing the charge polarity of the toner particles of said toner images that have been transferred on said final substrate in said first (I) printing system in case the toner particles used for development of electrostatic charge images in said first (I) and second (II) printing system have same charge polarity, said means (18, 19) being situated between said first (I) and second (II) printing system.

In a preferred embodiment of this invention said means for superimposing color separation images in registration on said final substrate (1) are a plurality of rotatable toner-image bearing photoconductive drums (4, 5, 6, 7 and 8) each forming in conjunction with said guiding member (3), in the form of a rotatable endless surface member, a nip wherethrough said final substrate (1) passes under pressure, said guiding member (3) being rotationally drivable for synchronous peripheral movement with said electrostatographic drums while guiding said web along said plurality of electrostatographic drums and said means for rotating said guiding member (3) for conveying said final substrate (1) are adapted for conveying said final substrate in synchronism with the peripheral movement of said toner-image bearing photoconductive drums (4, 5, 6, 7 and 8).

DETAILED DESCRIPTION OF THE INVENTION

Figure 1:
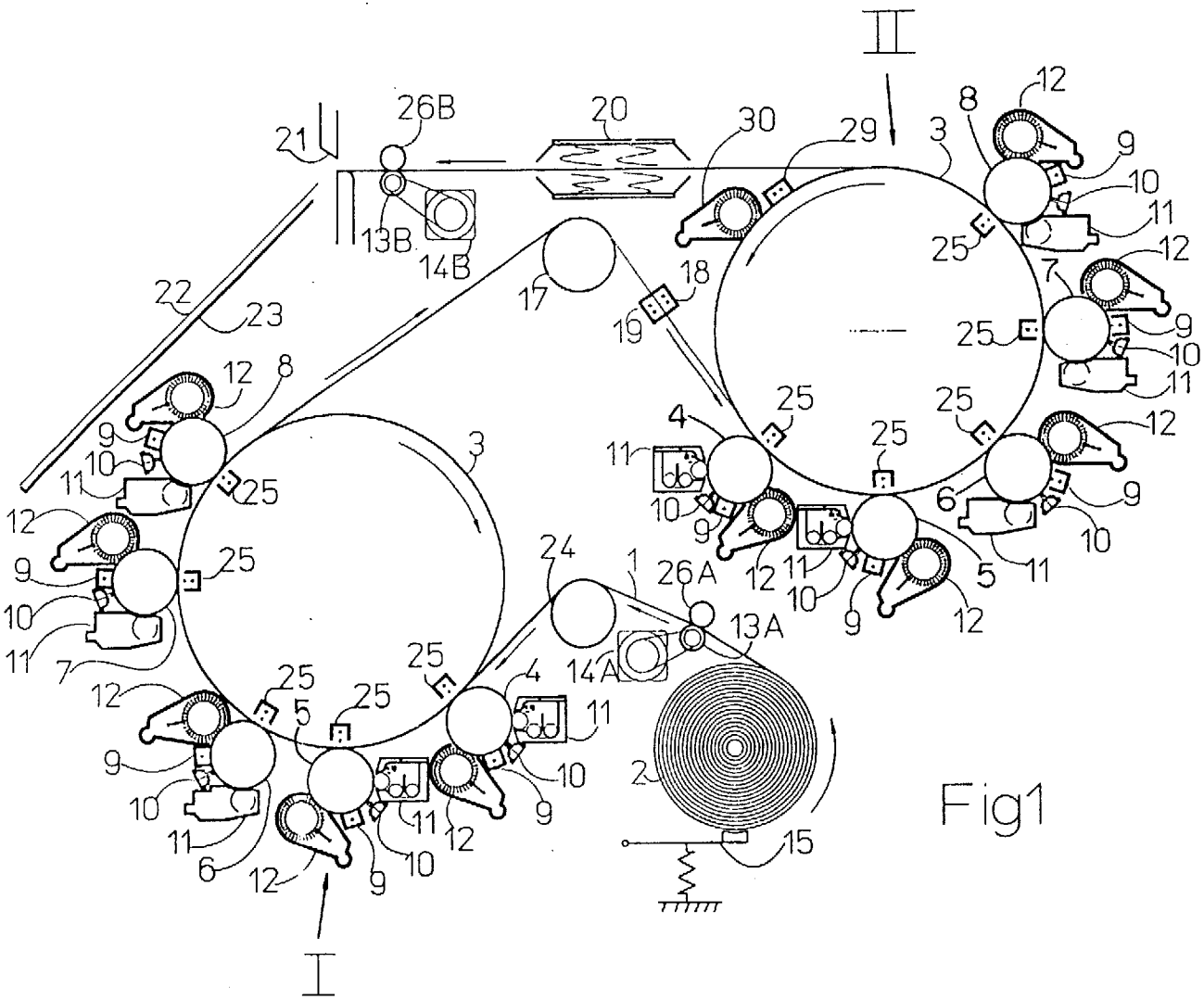
FIG. 1 represents a schematic cross-sectional view of a single-pass sequential duplex (double-side) multi-color electrostatographic printing machine operating with a plurality of photoconductive drums each arranged in conjunction with one web-guiding member in the form of a drum for each printing system.

In its broadest aspects, the present invention can be implemented in an apparatus comprising two printing systems being arranged in succession at opposite sides of a final substrate in web form (hereinafter the terminology "final substrate in web from" will be replaced by "web", for sake of simplicity), each of the printing systems comprising a guiding member (3) in the form of a rotatable endless surface member. On the web, guided by said guiding member, in each printing system, color separation images (i.e. a yellow, magenta, cyan and black image) are deposited in registration, by any known method for image-wise depositing toner particles on a final substrate. Since the apparatus comprises two printing systems on opposite sides of the final substrate (in web form), both sides of the final substrate can be printed in a single pass.

The endless rotatable guiding member associated with said apparatus is in the form of a circular drum or in the form of an endless belt.

A very suitable method for depositing toner particles on said final substrate (web) is the method of Direct Electrostatic Printing (DEP). In DEP a flow of charged toner particles from a toner source to a substrate is caused by an electric field between the toner source and a back electrode located behind said substrate. The flow of toner particles is imagewise modulated by a printhead structure, comprising printing apertures, that by applying changing electrical fields can either let toner particles pass or prevent the passing of the toner particles. When several DEP devices, each adapted for printing a color separation image, are located around the intermediate toner-receiving member in such a way that for each of the DEP devices this intermediate toner bearing member passes between a printhead structure and a back electrode, the color separation images can in registration be applied to said intermediate toner-receiving member. DEP devices are widely known in the art from several disclosures, e.g. devices known from U.S. Pat. No. 3,689,935, U.S. Pat. No. 4,320,408, U.S. Pat. No. 4,478,510, U.S. Pat. No. 4,743,926, U.S. Pat. No. 4,876,561, EP-A 390 847, U.S. Pat. No. 5,327,169, EP-A 675 417, JP-A 60/263962, etc, and each of the devices, that have been disclosed, can be adapted for use in a printing apparatus according to the present invention. It is easily understood that it is possible to locate more than one DEP device such that for each DEP device, having each a printhead structure and a back electrode, the web on the guiding member passes between the printhead structure and the back electrode.

Another useful method for depositing toner particles on the intermediate toner-receiving member is a printing device as described in EP-A 304 983. In such a printing device the color separations are made on an image-forming element in the form of a rotating drum provided with an electrostatic layer built up from a number of controllable electrodes in and beneath a dielectric layer. By imagewise applying a voltage on the controllable electrodes, toner particles are attracted from a toner source to the drum. It is possible to mount several of such image forming elements, each adapted for printing a color separation image, around the intermediate toner-receiving member of the present invention and apply the color separation images in registration on the intermediate toner-receiving member.

In a preferred embodiment of the invention, the color separation images are applied in registration to said web by a plurality of rotatable image-producing electrostatographic members that can be synchronously rotationally driven in contact with a common guiding member, that is either a drum or an endless belt.

The image-producing electrostatographic members in an apparatus according to the present invention are endless surface members in the apparatus according to the present invention and are in the form of drums or endless belts, but are preferably in the form of drums having the same diameter. The electrostatic image can be produced on said image-producing electrostatic members either by ionography (image-wise application of charges) or by electrophotography (imagewise exposure to light of a homogeneously charged photoconductive layer). This latter embodiment is the preferred embodiment to produce images on said electrostatographic image-producing members (electrostatographic drums).

According to one embodiment said rotatable guiding member in the form of a guiding or conveyor drum has an electrically biased metal wall, optionally externally coated with a thin dielectric layer, e.g. hydrophobic polymeric layer. Electric biasing of said conveyor drum versus toner deposited on said electrostatographic drums may be done with corona discharge devices arranged inside said conveyor drum opposite the electrostatographic drums. Said biasing serves for transferring the toner images from said electrostatographic drums onto the toner-receptor web that is conveyed by the rotatable guiding drum.

According to another embodiment said endless guiding member, also called conveyor member, is in the form of an electrically insulating endless belt that is electrostatically charged, e.g. by DC corona device, for toner-attraction from the electrostatographic drums onto the web-type receptor material. As an alternative for such attraction a bias potential is given to conductive backing rollers arranged inside said belt making contact therewith opposite to the electrostatographic drums.

The pressure applied on the web in the nip formed by said electrostatographic drums and guiding member helps in the transfer of toner particles onto the receptor web.

According to a preferred embodiment, said rotatable guiding member of the first printing system is operated as a drive roller coupled to a speed controllable motor, and the guiding member of the second printing system is operated as a drive roller coupled to a torque controllable motor. Hereby speed and web tension are kept under control for good image registration.

In case the toner particles used for developing in said first and second printing system have the same polarity the reversing of the polarity of the toner particles that have been deposited in the first printing system on one side of the receptor web is necessary before entering the second printing system in order to prevent said already deposited toner particles from becoming electrostatically transferred from the web onto the guiding member of the second printing system during the electrostatic transfer of the toner images that are formed in the second printing system at the other side of the receptor web.

For example, when negatively charged toner particles have been applied in the development of the latent electrostatic charge images in the first printing system a positive corona discharge directed to the side of the receptor web carrying the first image-wise deposited toner particles reverses their polarity whereby they become positively charged and prevented from transferring to the positively biased guiding member of the second printing system, while the negative toner particles serving as developer in the second printing system are attracted by the positively biased transfer member onto the receptor web at the side opposite the side that has received toner particles in the first printing system.

The reversing of toner polarity as described above can be omitted by using in the second printing system toner particles of a charge polarity opposite to the charge polarity of the toner particles used in the first printing system and by applying to the guiding member of the second printing system an electric bias of a polarity opposite to the polarity of the bias applied in the first printing system.

Some fixing or sintering of the toner particles of the images formed in the first printing system before passing the receptor web into the second printing system may also prevent transfer thereof to the guiding member of the second printing system. However, such intermediate fixing, especially when applying a considerable amount of heat, may give rise to distortion of the paper web, e.g. causes wrinkling of the paper by too strongly drying, so that misregistration of the toner images formed in the second printing system may take place.

However, by carefully controlling the heat applied in said intermediate fixing stage, e.g. by reducing fixing heat in combination with pressure, that is applied e.g. directly to the toner images with a hot pressure roller, misregistration of the toner images later on formed at the other side of the receptor web may be kept at a minimum.

According to an embodiment the present electrostatographic printing machine contains an intermediate roller guiding the receptor web in between the two printing systems, but said roller makes no contact with the toner images already formed in the first printing system. For intermediate fixing purposes said intermediate roller may be combined with a hot pressure roller contacting the paper web in the nip formed with said intermediate roller. In that case said intermediate roller has preferably a resilient surface structure thereby increasing the contact of the toner images on the web with the surface of the hot pressure roller.

The preferred embodiments of the present invention, where the color separation images, and optionally other toner layers as, e.g. gloss equalizing layers, protective layers, image relief equalizing layers, etc, are applied in registration on a final substrate in web form by electrophotographic means and then transferred to a final substrate being in web form will be discussed more in detail with reference to the accompanying drawings.

Referring in detail to FIG. 1 the printing machine contains as printing stock a paper web 1 that is fed from a paper supply roller 2 over a guiding or conveyor roller 24 along a part of the circumference of a first guiding or conveyor drum 3 in tangential pressure contact with five photoconductive drums (4, 5, 6, 7 and 8). The first four drums (4, 5, 6 and 7) following the direction of the passage of the web represent respectively a cyan, magenta, yellow and black toner image-producing station. Photoconductive drum 8, which is present optionally, represents a toner image-producing station for printing an additional color (customized color) or for image-wise coating the already deposited toner images with a toner that controls image gloss and/or improves after fixing the resistance to abrasion of the obtained toner images.

Each photoconductive drum is associated at its periphery with a corona-charging source 9 for uniformly charging the photoconductive layer of the drum. A LED-array exposure source 10 is exposing each photoconductive drum according to the selected color information, e.g. color information representing a red, green or blue light separation image of a multi-color original to be reproduced in printed form.

The exposure of the different photoconductive drums for proper printing of monochrome images in registration proceeds e.g. as described in published EP-A 631 204 using signals of an encoder means (see therein FIGS. 6, 6A, 7, 8A, 8B, 9 and 10) for synchronizing the superposition of the selected separation images.

Each photoconductive drum has its associated toner development unit 11, e.g. magnetic brush development unit, and cleaning unit 12, e.g. a brush cleaning unit with suction exhaust, for removing residual non-transferred toner particles. Inside said guiding drum 3 transfer coronas 25 are facing each photoconductive drum (4, 5, 6, 7 and 8).

As illustrated in the FIG. 1 embodiment of a printing apparatus according to the present invention the guiding members 3 and photoconductive drums (4, 5, 6, 7 and 8) obtain synchronous peripheral movement by means of the web itself that is actuated by passing it through the nip of pressure backing rollers (26A, 26D) and driver rollers (13A, 13B) coupled each to an electric motor (14A, 14B).

Thus, according to the illustrated embodiment the paper web 1 itself drives the guiding drums 3 and photoconductive drums (4, 5, 6, 7 and 8). One of the motors 14A is speed controlled at such a rotational speed as to drive the web through the printer at the required speed, which may for example be about 125 m/sec. The other motor 14B is torque controlled in such a way as to generate a web tension of, for example, about 1 N/cm web width. A brake 15 acting on the supply roller 2 provides also for the necessary tension in the web 1.

According to another embodiment (not illustrated in FIG. 1) the photoconductive drums (4, 5, 6, 7 and 8) are driven by the guiding drums 3 (driven at the same peripheral speed under control of electric pulses from an encoder means arranged on their axis). Sufficient pressure is exerted on the paper web 1 in the nip formed with the photoconductive drums. In that way the rotational movement of said photoconductive drums is controlled by the peripheral speed of the outer surface of said guiding drum 3, so that there is almost no slippage between the drums. Hereby toner images being in non-fixed state and carried by the photoconductive drums are transferred, i.e. offset, in good superposing registration onto the paper web 1.

Each toner image adhering to its photoconductive drum is transferred by electrostatic force onto the paper web 1 through the electric field formed by the biased guiding drum 3, which inside contains a transfer corona 25 opposite each photoconductive drum.

Before arriving at the second printing system the paper web 1 is conveyed over an intermediate guiding roller 17 that does not make contact with the already deposited toner images. Roller 17 may be biased with an electric charge polarity opposite to the charge polarity of the toner particles on the paper web.

According to an embodiment (not shown in FIG. 1) said intermediate roller 17 forms a nip with a hot pressure roller for passing therethrough the paper web and fixing the toner images already deposited in the first printing system. A heating roller suitable for use in hot-pressure fixing is described e.g. in U.S. Pat. No. 4,550,243 and in IBM J. Res. Develop. —Vol. 22, No. 1 January 1978, in the article "Design of the Fusing System for an Electrophotographic Laser Printer" by K. D. Brooms.

According to an embodiment (not shown in FIG. 1) said intermediate roller 17 is omitted and the paper web passes directly from the guiding drum 3 of the first printing system I into contact with the guiding drum 3 of the second printing system II.

After leaving the first printing system and before entering the second printing system the paper web 1 passes between two DC (direct current) corona devices 18 and 19 producing corona streams of opposite polarity for reversing the polarity of the toner that have been deposited already on one side of the paper web. The corona stream directed to the side of the paper web 1 carrying the toner images deposited in the first printing system has a polarity opposite to the polarity of the toner particles used in the development applied in the first printing system.

For example, when using negatively charged toner particles in the several development stations (by development station is meant the means for bringing several color separation images in register on the final substrate, in this figure each development station comprises around a photoconductive drum (4, 5, 6, 7, and 8) an exposure source 10, a corona-charging source 9, a toner development unit 11 and a cleaning unit 12 of the two printing systems, the polarity of the toner particles that have been deposited in the first printing system is reversed and becomes positive. Hereby in the second printing system said positively charged toner particles on the paper web side contacting the positively biased guiding drum 3 are electrostatically repelled therefrom and remain on their side of the paper web 1, while the negatively charged toner particles of the toner images formed in the second printing system are attracted, i.e. transferred, from the photoconductive drums onto the other side of the paper web 1.

In FIG. 1 the members of the second printing system functioning in the same way as in the first printing system have obtained the same numbering as in the first printing system. The whole process as described for the first printing system is repeated but at the opposite side of the paper web 1. By conveying the paper web 1 through a final fixing station, being here an infra-red radiant station 20, the toner images are fused on both sides of the paper web 1. The fixing station 20 is followed by a cutting station 21 in case prints in sheet form are required. The printed sheets 22 are passed over a guiding platen 23 and collected in a sorter (not shown in FIG. 1).

Toner particles optionally clinging to the surface of the guiding drum 3 of the second printing system II are removed with a cleaning station 30 preceded with an alternating current corona 29.

Figure 2:
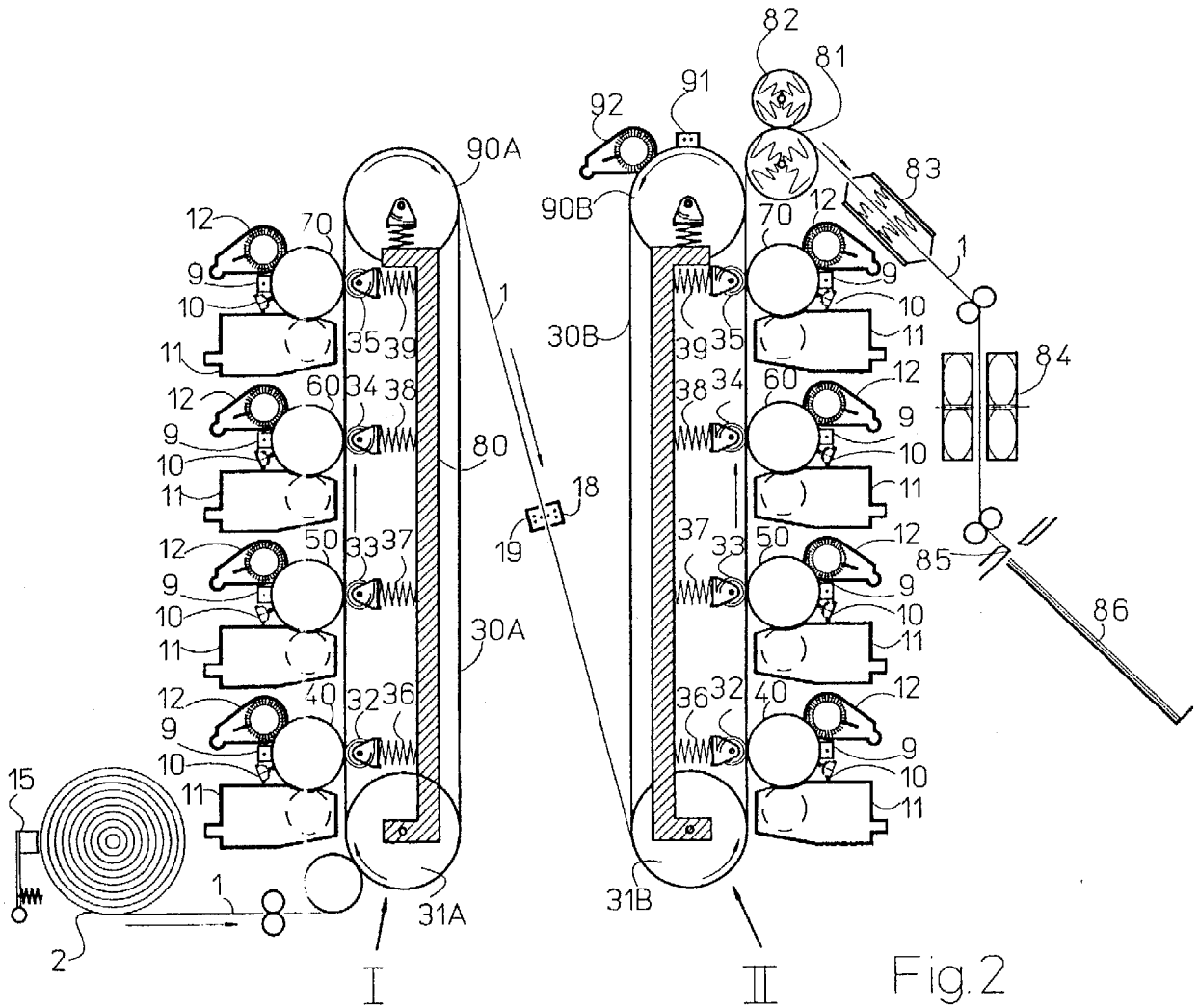
FIG. 2 represents a schematic cross-sectional view of a single-pass sequential duplex (double-side) multi-color electrostatographic printing machine operating in each printing system with a plurality of photoconductive drums arranged in conjunction with a web-guiding member in the form of an endless belt.

FIG. 2 represents in a schematic cross-sectional view another embodiment of a sequential duplex (double-side) multi-color electrostatographic printing machine according to the present invention, wherein a paper web guiding member of each printing system is in the form of a rotatable endless belt.

Rotatable endless belt systems have been used before in double-side printing. For example, in U.S. Pat. No.

4,095,979 an endless photoconductive belt is described for forming thereon intermediately toner images that are transferred from said belt onto paper sheets. However, each intermediate toner transfer before arriving at the final print may be a source of image distortion. Moreover, transfer of the toner particles from said belt member is not complete, so that said belt requires regular cleaning. Such results in a loss of toner before the final print is formed.

According to the embodiment of the present invention operating with an endless non-photoconductive belt as guiding member for a toner-receptor web, e.g. roll-fed paper web, there is a direct transfer of the toner images from toner-image forming electrostatographic drums onto the final image carrier, i.e. the paper web.

In said embodiment illustrated in FIG. 2 the photoconductive drums (40, 50, 60 and 70) of the first (I) and second (II) printing system, while contacting paper web 1 fed from feed roller 2 combined with web-tension controlling brake 15, are driven respectively by means of endless belts 30A and 30B. Each belt is rotated by a drive roller 31A and 31B each of which is connected through its axis to a speed-controllable electric motor (not shown in FIG. 2). The individual electric motors driving the belts (30A, 30B) of the first (I) and second (II) printing system are operated synchronously using for their speed control an encoder (not shown in FIG. 2) on the rotation axis of the drive rollers (31A and 31B) . Timing pulses provided by said encoders ensure synchronism of peripheral speed of both the belts 30A and 30B. A suitable encoder for that purpose is described e.g. in U.S. Pat. No. 5,119,128. The belts 30A and 30B are guided over belt-tensioning conveyor rollers 90A and 90B respectively.

Inside the belts (30A, 30B) rotatable idle backing rollers (32, 33, 34 and 35) are present opposite the photoconductive drums (40, 50, 60 and 70). These backing rollers (32, 33, 34 and 35) are rotating about an axis that is pushed by springs (36, 37, 38 and 39) that are supported by the machine-frame 80 against the innerside of the endless belts. The pressure-load exerted by the springs on said backing rollers is mechanically or electromagnetically controllable. The backing rollers simultaneously serve as electrically biased guiding rollers that provide the necessary electric propulsion for the transfer of toner particles from the photoconductive drums (40, 50, 60 and 70) onto the paper web 1.

Each photoconductive drum is associated at its periphery with a corona-charging source 9 for uniformly charging the photoconductive layer of the drum. A LED-array exposure source 10 is exposing each photoconductive drum according to the selected color information.

Further each photoconductive drum has its associated toner development unit 11, e.g. dry toner magnetic brush development unit or tray containing liquid toner, and cleaning unit 12, e.g. a brush cleaning unit with suction exhaust, for removing residual non-transferred toner particles and optionally taking away residual carrier liquid of liquid toner from the photoconductive drums.

Downstream the first printing system the paper web 1 passes between two corona devices 18 and 19 producing corona streams of opposite polarity for reversing the polarity of the toner particles that have been deposited already on one side of the paper web. The corona stream directed to the side of the paper web 1 carrying the toner images deposited in the first printing system (I) has a polarity opposite to the polarity of the toner particles that have been used in the development applied in the first printing system.

In the second printing system (II) the whole process as described for the first printing system (I) is repeated but at the opposite side of the paper web 1.

At the top of the belt 30B a cleaning station 92 preceded with alternating current corona 91 removes toner particles optionally transferred on said belt from the non-fixed toner images formed in the first printing system.

By conveying the paper web 1 carrying at both sides non-fixed superposed toner images in the nip between an internally heated reversing roller 81 and internally heated pressure backing roller 82 the toner particles of the toner images at both sides of the paper web 1 are pre-fixed. The pre-fixed toner images are passed through an infra-red radiation fixing station 83 (see therefor e.g. published EP-A 629 930). The fixing station 83 is optionally followed by a paper cooling station 84, whereupon the printed paper web, when sheets are required, is fed in a cutting station 85 and from there sheets are collected in a tray 86.

For the compactness of each printing module, preference is given to the use of an array of light-emitting diodes (LEDs) as exposure sources (ref. e.g. published EP-A 629 924), but the exposure of the photoconductive drums may proceed likewise with image-wise modulated laser beams.

Other useful exposure sources are in the form of an array of deformable mirrors, or digital mirror devices (DMD's), and are described e.g. in U.S. Pat. Nos. 5,206,629 and 5,289,172.

The development of the latent electrostatic images proceeds preferably with electrostatically attractable marking material, called toner, that may be in the from of dry solid triboelectrically charged particles or in the form of a dispersion of charged toner particles in a carrier liquid (liquid developer) and such preferably according to the known principles of reversal development.

A preferred negatively charged dry toner powder in admixture with carrier particles is described in published (PCT) WO 94/27191.

A preferred positively charged dry toner powder in admixture with carrier particles is described in published (PCT) WO 94/29770.

A survey of different techniques used in the development of electrostatic charge images is given in U.S. Pat. No. 5,012,288 and IEEE Transactions on Electronic Devices, Vol. ED-19, No. 4, April 1972 by Thomas L. Thourson under the title: "Xerographic Development Processes": A Review.

Magnetic brush development is particularly reliable. Herein magnetic carrier particles carrying triboelectrically charged toner particles are used or monocomponent colored magnetic toners as described e.g. in published EP-A 184 714.

Non-magnetic toners may be used advantageously in non-magnetic contact or impression development (ref. e.g. Journal of Imaging Science and Technology—Vol. 37, No. 3, May/June 1993, p. 223–230).

Fixing of dry toner images may proceed by radiant heat (infra-red radiation) as described e.g. in published European patent application 0 629 930 or by hot roll fuser.

Liquid toner development may be carried out as described, e.g. in U.S. Pat. Nos. 3,168,021 or 4,770,967 with development liquid supplied from a tubular member or from a tray. According to another technique an ink jet is used as liquid toner applicator as described e.g. in U.S. Pat. No. 3,052,213 or liquid toner is applied from a container having slots as described e.g. in U.S. Pat. No. 4,545,326 or from a reservoir with flow-through as described in GB-P 1,125,628.

The liquid toner may be in fairly high concentrated form as described e.g. in U.S. Pat. No. 5,192,638.

Fixing of toner particles of liquid toner dispersions may proceed as described e.g. in published EP-A 0 244 199, 0 244 198 or in U.S. Pat. Nos. 4,063,530, 4,745,432 and 4,842,972.

The duplex printers according to the present invention may be used for single-pass simultaneous double-side printing on every flexible web-type support, e.g. paper, plastified paper, plastified fabric, plastic supports, plastified metal web, cardboard, etc.

We claim:

1. An electrostatographic printing apparatus suited for single-pass sequential multi-color duplex printing by depositing and fixing toner particles on a final substrate in web form, said apparatus comprising:

first and second printing systems arranged in succession at opposite sides of said final substrate, said first printing system comprising a first guiding member and said second printing system comprising a second guiding member, each of said guiding members being in the form of a rotatable endless surface member;

means for rotating said guiding members and conveying said final substrate;

means, in each of said printing systems, for superimposing color separation images, in the form of toner images, in registration on said final substrate conveyed by said guiding members; and means for reversing the charge polarity of the toner particles of said toner images that have been transferred on said final substrate in said first printing system in case the toner particles used for development of electrostatic charge images in said first and second printing systems have the same polarity, said polarity-reversing means being situated between said first and second printing systems.

2. The apparatus according to claim 1, wherein said means for superimposing color separation images in registration on said final substrate are DEP printing devices.

3. The apparatus according to claim 1, wherein said means for superimposing color separation images in registration on said final substrate comprise an image-forming element in the form of a rotating drum provided with an electrostatic layer built up from a number of controllable electrodes in and beneath a dielectric layer.

4. The apparatus according to claim 1, wherein:

said means for superimposing color separation images in registration on said final substrate comprises:

a plurality of rotatable toner-image bearing members; and a plurality of nips formed by said rotatable toner-image bearing members acting in conjunction with said guiding members; and said rotating means drives said guiding members in synchronous peripheral movement with said rotatable toner-image bearing members and guides said final substrate along with said rotatable toner-image bearing members, said rotating means being adapted for conveying said final substrate in synchronism with said peripheral movement of said rotatable toner-image bearing members.

5. The apparatus according to claim 4, wherein:

said rotatable toner-image bearing members comprise photoconductive drums, each comprising a conductive support and a photoconductive layer mounted upon said conductive support; and said apparatus further comprises:

means for developing electrostatic charge images produced on said rotatable toner-image bearing members with said toner particles; and means for transferring said toner particles corresponding to said toner images from said rotatable toner-image bearing members onto said final substrate.

6. The apparatus according to claim 5, wherein said rotating means for rotationally driving said guiding members in synchronism with said rotatable toner-image bearing members comprises said final substrate, such that movement of said final substrate controls the peripheral speed of said guiding members and said rotatable toner-image bearing members.

7. The apparatus according to claim 4, wherein said guiding members are rotatable endless guiding members.

8. The apparatus according to claim 4, wherein said guiding members are endless belts.

9. The apparatus according to claim 4, wherein said first guiding member is a first circular rotatable drum, and said second guiding member is a second circular rotatable drum.

10. The apparatus according to claim 9, wherein said rotating means comprises electric motors for driving said first and second circular rotatable drums.

11. The apparatus according to claim 10, wherein said rotating means comprises a speed controllable motor coupled to said first circular rotatable drum.

12. The apparatus according to claim 10, wherein said rotating means comprises a torque controllable motor coupled to said second circular rotatable drum.

13. The apparatus according to claim 4, further comprising an intermediate roller for guiding said final substrate, wherein said intermediate roller is located between said first and second printing systems such that said intermediate roller does not contact said toner images formed in said first printing system.

14. The apparatus according to claim 13, further comprising:

a hot pressure roller; and an additional nip, formed by said hot pressure roller acting in conjunction with said intermediate roller, through which said final substrate is conveyed for fixing toner images formed in said first printing system.

15. The apparatus according to claim 4, wherein said toner particles are dry electrostatically charged toner particles.

16. The apparatus according to claim 4, further comprising a magnetic brush for applying said toner particles to said final substrate.

17. The apparatus according to claim 4, wherein said toner particles comprise triboelectrically charged toner particles carried by magnetic carrier particles.

18. The apparatus according to claim 4, wherein said toner particles comprise mono-component colored toner particles.

19. The apparatus according to claim 4, wherein said toner particles comprise non-magnetic toner particles for contact or impression development.

20. The apparatus according to claim 4, wherein said toner particles are dispersed in a liquid carrier medium.

21. An electrostatographic printing apparatus suited for single-pass sequential multi-color duplex printing by depositing and fixing toner particles on a final substrate in web form, said apparatus comprising:

first and second printing systems arranged in succession at opposite sides of said final substrate, said first printing system comprising a first guiding member and said second printing system comprising a second guiding member, each of said guiding members being in the form of a rotatable endless surface member;

means for rotating said guiding members and conveying said final substrate; and means, in each of said printing systems, for superimposing color separation images, in the form of toner images, in registration on said final substrate conveyed by said guiding members, wherein said first printing system and said second printing system each use said toner particles to form said toner images, and wherein said toner particles used in said first printing system have essentially a charge polarity opposite to the charge polarity of said toner particles used in said second printing system.

22. The apparatus according to claim 21, wherein said means for superimposing color separation images in registration on said final substrate are DEP printing devices.

23. A printing apparatus according to claim 21, wherein said means for superimposing color separation images in registration on said final substrate comprise an image-forming element in the form of a rotating drum provided with an electrostatic layer built up from a number of controllable electrodes in and beneath a dielectric layer.

24. The apparatus according to claim 21, wherein:

said means for superimposing color separation images in registration on said final substrate comprises:

a plurality of rotatable toner-image bearing members; and a plurality of nips formed by said rotatable toner-image bearing members acting in conjunction with said guiding members; and said rotating means drives said guiding members in synchronous peripheral movement with said rotatable toner-image bearing members and guides said final substrate along with said toner-image bearing members, said rotating means being adapted for conveying said final substrate in synchronism with said peripheral movement of said toner-image bearing members.

25. The apparatus according to claim 24, wherein:

said rotatable toner-image bearing members are photoconductive drums each comprising a conductive support and a photoconductive layer mounted on said conductive support; and said apparatus further comprises:

means for developing electrostatic charge images produced on said rotatable toner-image bearing members with said toner particles; and means for transferring said toner particles corresponding to said toner images from said rotatable toner-image bearing members onto said final substrate.

* * * * *